US011527806B1

(12) United States Patent
Lewellen et al.

(10) Patent No.: US 11,527,806 B1
(45) Date of Patent: Dec. 13, 2022

(54) WAVEGUIDE FLANGE ADAPTER CONFIGURED TO CONNECT WITH FIRST AND SECOND WAVEGUIDE FLANGES, WHERE THE FIRST AND SECOND FLANGES HAVE HOLE PATTERNS THAT ARE DIFFERENT

(71) Applicant: Government of the United States, as represented by the Secretary of the Air Force, Kirtland AFB, NM (US)

(72) Inventors: John W. Lewellen, Los Alamos, NM (US); Rufus Cooksey, Albuquerque, NM (US); John R. Harris, Albuquerque, NM (US)

(73) Assignee: United States of America as represented by the Secretary of the Air Force, Kirtland AFB, NM (US)

( * ) Notice: Subject to any disclaimer, the term of this patent is extended or adjusted under 35 U.S.C. 154(b) by 205 days.

(21) Appl. No.: 16/892,571

(22) Filed: Jun. 4, 2020

(51) Int. Cl.
*H01P 1/04* (2006.01)
*H01P 11/00* (2006.01)
*H01P 5/02* (2006.01)

(52) U.S. Cl.
CPC ..... *H01P 1/042* (2013.01); *H01P 5/02* (2013.01); *H01P 11/002* (2013.01)

(58) Field of Classification Search
CPC ..... H01P 1/042
USPC ..... 333/254
See application file for complete search history.

(56) References Cited

U.S. PATENT DOCUMENTS 3,303,440 A * 2/1967 Meyer ..... H01P 1/042 333/254
3,374,450 A * 3/1968 Stewart ..... H01P 1/042 285/253
3,400,344 A * 9/1968 Booth ..... H01P 1/042 333/254

* cited by examiner

*Primary Examiner* — Benny T Lee
(74) *Attorney, Agent, or Firm* — AFMCLO/JAZ; David L. Narciso

(57) ABSTRACT

A waveguide flange adapter includes a plate; an aperture positioned through the plate; and a plurality of holes arranged in a pattern in the plate and around the aperture. The plate is configured to operatively connect a first waveguide to a second waveguide such that the first waveguide and the second waveguide have a different pattern of holes on the waveguide flanges to one another. The pattern of the plurality of holes may be configured to align with connecting holes in each of the first waveguide and the second waveguide. At least some of the plurality of holes may extend through an entire thickness of the plate. The plate may include electrically-conductive material. The size and shape of the aperture may be complementary to a size and shape of each of the first waveguide and the second waveguide. At least some of the plurality of holes may be tapped or untapped.

17 Claims, 11 Drawing Sheets

10
15
25
t

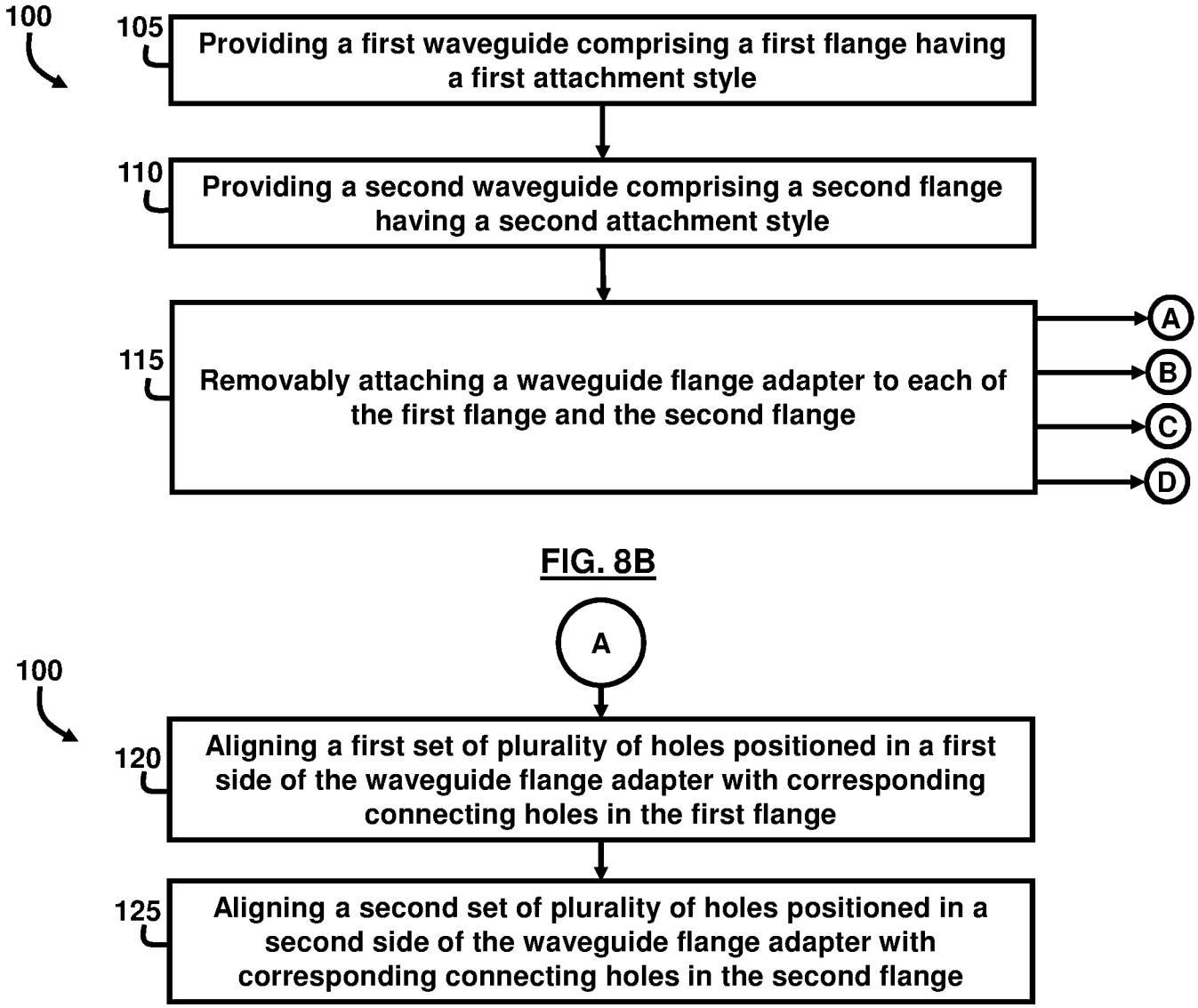
FIG. 8A
100
105
Providing a first waveguide comprising a first flange having a first attachment style
110
Providing a second waveguide comprising a second flange having a second attachment style
115
Removably attaching a waveguide flange adapter to each of the first flange and the second flange
A
B
C
D
FIG. 8B
100
A
120
Aligning a first set of plurality of holes positioned in a first side of the waveguide flange adapter with corresponding connecting holes in the first flange
125
Aligning a second set of plurality of holes positioned in a second side of the waveguide flange adapter with corresponding connecting holes in the second flange

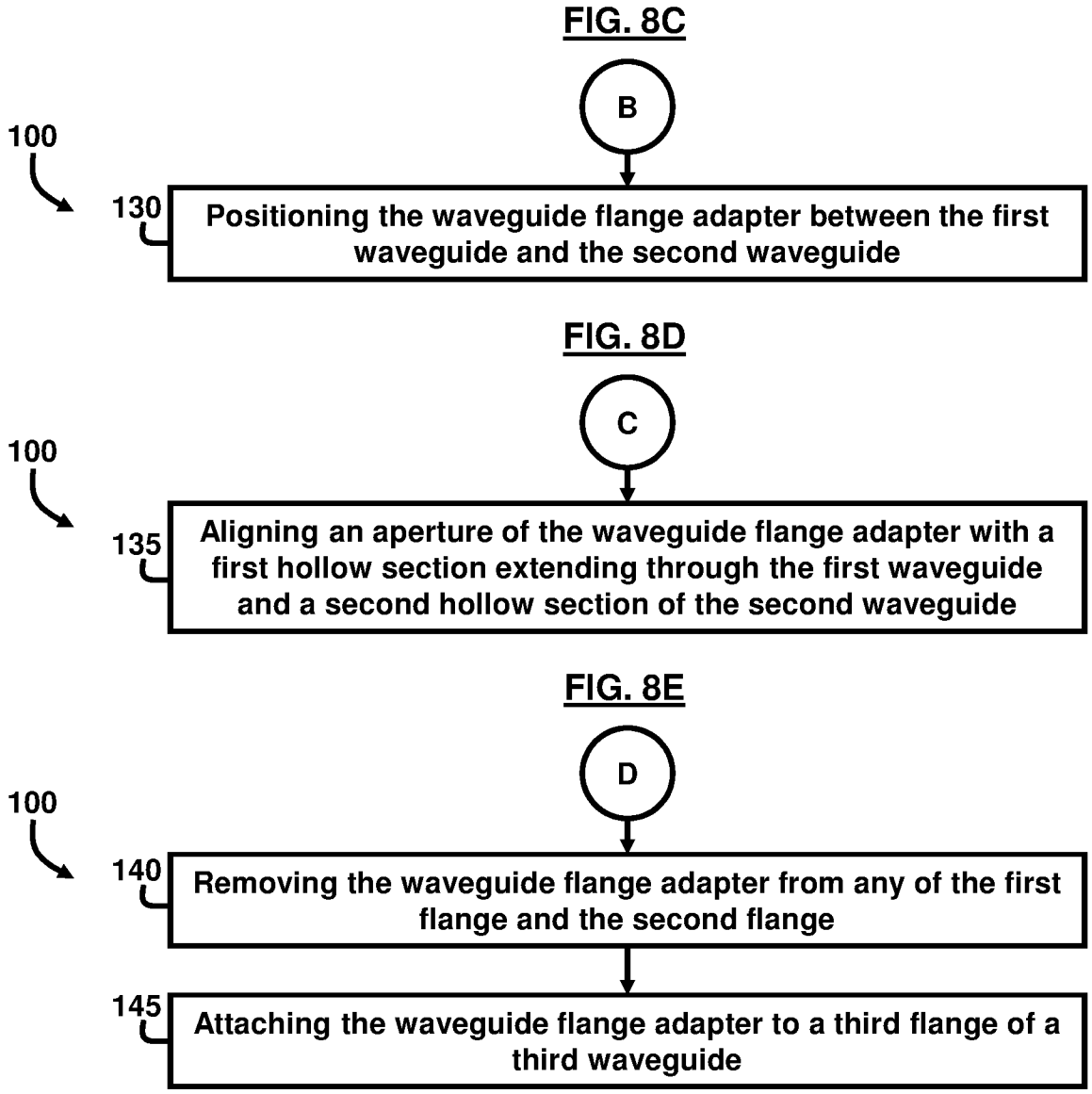
FIG. 8C
B
Positioning the waveguide flange adapter between the first waveguide and the second waveguide
130
100
FIG. 8D
C
Aligning an aperture of the waveguide flange adapter with a first hollow section extending through the first waveguide and a second hollow section of the second waveguide
135
100
FIG. 8E
D
Removing the waveguide flange adapter from any of the first flange and the second flange
140
Attaching the waveguide flange adapter to a third flange of a third waveguide
145
100

WAVEGUIDE FLANGE ADAPTER CONFIGURED TO CONNECT WITH FIRST AND SECOND WAVEGUIDE FLANGES, WHERE THE FIRST AND SECOND FLANGES HAVE HOLE PATTERNS THAT ARE DIFFERENT

GOVERNMENT INTEREST

The invention described herein may be manufactured and used by or for the Government of the United States for all government purposes without the payment of any royalty.

BACKGROUND

Field of the Invention

The embodiments herein generally relate to signal transmission devices, and more particularly to waveguides used for transmission of electromagnetic signals.

Background of the Invention

A waveguide is widely used to transport Radio Frequency (RF) waves from one location to another. A waveguide typically includes a hollow metal tube of circular or rectangular cross-section, and is found in applications including radar, High Power Microwave (HPM) systems, and particle accelerators, among others. A waveguide is typically produced in sections which are held together by flanges. These flanges ensure both mechanical alignment of the waveguide tubes and electrical connection between the tubes. These flanges may also include grooves to prevent loss of RF signals (RF chokes) or to admit gaskets (typically of soft metal such as indium) to allow pressurization of the waveguide with gas such as sulfur hexafluoride to suppress electrical breakdown during high power operation.

Multiple flange types are available for the same waveguide section and dimensions. It often occurs that experimenters or engineers will reuse a waveguide section salvaged from earlier systems, and in these situations, it may be necessary to combine waveguide sections having different flange types. Similar compatibility issues often occur when attempting to retrofit or upgrade older equipment, or to repair existing installations. The typical solution is to purchase or construct a custom segment of waveguide, with one flange type on one end of the waveguide, and another type on the opposite end. However, this is time-consuming, expensive, and physically can require significant modification of the waveguide system to make room for the new section of waveguide.

SUMMARY OF THE INVENTION

In view of the foregoing, an embodiment herein provides a waveguide flange adapter comprising a plate; an aperture positioned through the plate; and a plurality of holes arranged in a pattern in the plate and around the aperture, wherein the plate is configured to operatively connect a first waveguide to a second waveguide such that the first waveguide and the second waveguide comprise a same or different waveguide flange type to one another. The pattern of the plurality of holes may be configured to align with connecting holes in each of the first waveguide and the second waveguide. At least some of the plurality of holes may extend through an entire thickness of the plate. The plate may comprise electrically-conductive material. The size and shape of the aperture may be complementary to a size and shape of each of the first waveguide and the second waveguide. At least some of the plurality of holes may be tapped. Alternatively, at least some of the plurality of holes may be untapped.

Another embodiment provides a waveguide flange adapter comprising a plate having a first side and a second side; an aperture positioned through a substantially central portion of the plate; a first set of plurality of holes arranged in a first pattern in the first side of the plate and around the aperture; and a second set of plurality of holes arranged in a second pattern in the second side of the plate, wherein the first side of the plate is configured to connect to a first waveguide, and wherein the second side of the plate is configured to connect to a second waveguide. The first pattern and the second pattern may be the same in that the pattern of the holes on the first waveguide flange match the pattern of the holes on the second waveguide flange. Alternatively, the pattern of holes on the first waveguide flange and the pattern of holes on the second waveguide flange may be different. The waveguide flange adapter may comprise one or more grooves adjacent to the aperture. The grooves may be configured to serve as a choke or accommodate a gasket. The grooves may surround the aperture. The first waveguide and the second waveguide may comprise a same or different waveguide flange type to one another, either in the shape of the waveguide flange, the pattern of the holes, the configuration of groves, or a combination thereof.

Another embodiment provides a method of connecting waveguides, the method comprising providing a first waveguide comprising a first flange having a first pattern of holes; providing a second waveguide comprising a second flange having a second pattern of holes; and removably attaching a waveguide flange adapter to each of the first flange and the second flange, wherein the first pattern of holes and the second pattern of holes are different to one another. The method may comprise aligning a first set of plurality of holes positioned in a first side of the waveguide flange adapter with corresponding connecting holes in the first flange; and aligning a second set of plurality of holes positioned in a second side of the waveguide flange adapter with corresponding connecting holes in the second flange. The method may comprise positioning the waveguide flange adapter between the first waveguide and the second waveguide. The method may comprise aligning an aperture of the waveguide flange adapter with a first hollow section extending through the first waveguide and a second hollow section of the second waveguide to permit the first hollow section and the second hollow section to create a continuous tube. The method may comprise removing the waveguide flange adapter from any of the first flange and the second flange; and attaching the waveguide flange adapter to a third flange of a third waveguide.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which:

FIG. 8A is a flow diagram illustrating a method of connecting waveguides, according to an embodiment herein;

FIG. 8B is a flow diagram illustrating a method of aligning holes of a waveguide flange adapter with holes in flanges of waveguides according to the method of FIG. 8A, according to an embodiment herein;

FIG. 8C is a flow diagram illustrating a method of positioning a waveguide flange adapter according to the method of FIG. 8A, according to an embodiment herein;

FIG. 8D is a flow diagram illustrating a method of aligning an aperture of a waveguide flange adapter according to the method of FIG. 8A, according to an embodiment herein; and FIG. 8E is a flow diagram illustrating removably attaching a waveguide flange adapter from waveguides according to the method of FIG. 8A, according to an embodiment herein.

DETAILED DESCRIPTION OF THE INVENTION

Figure 1B:
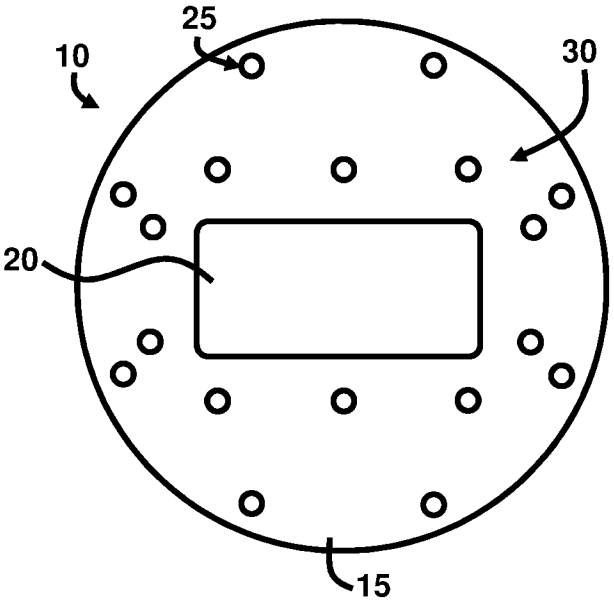
FIG. 1B is a schematic plan view illustrating the waveguide flange adapter of FIG. 1A, according to an embodiment herein.

Embodiments of the disclosed invention, the various features thereof and the advantageous details thereof, are explained more fully with reference to the non-limiting embodiments that are illustrated in the accompanying drawings and detailed in the following description. Descriptions of well-known components and processing techniques are omitted to not unnecessarily obscure what is being disclosed. Examples may be provided and when so provided are intended merely to facilitate an understanding of the ways in which the invention may be practiced and to further enable those of skill in the art to practice its various embodiments. Accordingly, examples should not be construed as limiting the scope of what is disclosed and otherwise claimed.

The embodiments herein provide a waveguide flange adapter that connects to waveguide flanges in order to connect two waveguides together. The waveguide flange adapter includes a pattern of holes on each side of the adapter that can align with holes on the waveguides. A direct flange-to-flange adapter, as provided by the embodiments herein, is less expensive, faster, and easier to fabricate when compared to the conventional solutions, and utilizes far less room in an existing waveguide network. Referring now to the drawings, and more particularly to FIGS. 1A-1C, 2, 3A-3D, 4A, 4B, 5A-5C, 6A-6D, 7A, 7B, 8A-8E, where similar reference characters denote corresponding features consistently throughout, there are shown exemplary embodiments. In the drawings, the size and relative sizes of components, layers, and regions, etc. may be exaggerated for clarity.

Figure 1A:
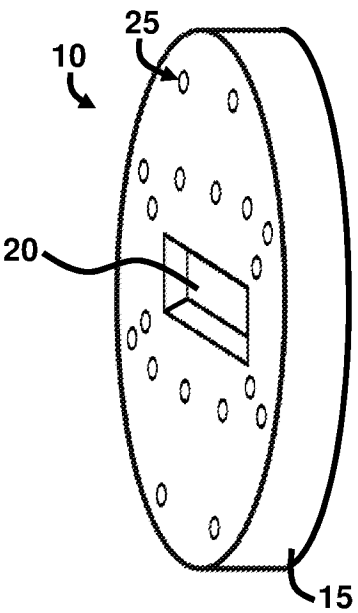
FIG. 1A is a schematic perspective view illustrating a waveguide flange adapter, according to an embodiment herein.
Figure 1C:
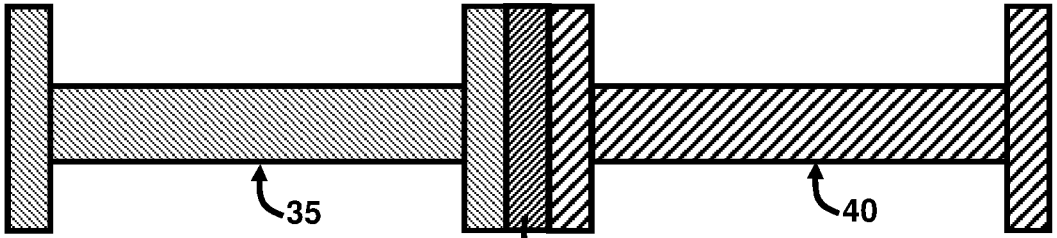
FIG. 1C is a schematic side view illustrating the waveguide flange adapter of FIG. 1A connected to a pair of waveguides, according to an embodiment herein.

FIGS. 1A-1C illustrate a waveguide flange adapter 10 (FIGS. 1A and 1B) comprising a plate 15, an aperture 20 (FIGS. 1A and 1B) positioned through the plate 15, and a plurality of holes 25 (FIGS. 1A and 1B) arranged in a pattern 30 (FIG. 1B) in the plate 15 and around the aperture 20. The plate 15 is configured to operatively connect a first waveguide 35 to a second waveguide 40 such that the first waveguide 35 and the second waveguide 40 comprise a same or different waveguide flange type to one another as shown in FIG. 1C. The plate 15 comprises an electrically-conductive material. Example materials may include brass, copper, silver, aluminum, or any metal that has low bulk resistivity. Moreover, the plate 15 may comprise a composite of different electrically-conductive materials, and may, for example, comprise a different material than any of the first waveguide 35 and the second waveguide 40.

The plate 15 may comprise any suitable size, thickness, or shape. In some examples, the plate 15 may be a circular disk-shaped structure. However, other shapes and configurations are possible in accordance with the embodiments herein. An example configuration of the thickness of the plate 15 may be approximately 0.5 inches and if configured in a disk-shaped configuration, the diameter of the plate 15 may be approximately 5.313 inches, although other thicknesses and diameters are possible in accordance with the embodiments herein. The aperture 20 is cut through the entire thickness of the plate 15, and may comprise any suitable size, shape, or configuration. For example, the aperture 20 may comprise a size and shape that matches the corresponding size and shape of the openings of the first waveguide 35 and second waveguide 40 that are to be connected to the plate 15. According to an example, the aperture 20 may comprise rounded corners, although other configurations are possible, in accordance with the embodiments herein. Some example dimensions of the aperture 20 may include a width of approximately 2.84 inches and a length of approximately 1.34 inches, although other dimensions are possible in accordance with the embodiments herein.

The pattern 30 containing the plurality of holes 25 may be provided in any suitable arrangement (and not limited to the pattern 30 depicted in the drawings) with any suitable spacing and angle, etc. between the plurality of holes 25. According to an example, the plurality of holes 25 may comprise the same size, shape, and configuration as one another. In another example, the plurality of holes 25 may comprise different sizes, shapes, and configurations as one another. In an example configuration, the plurality of holes 25 each comprise a circular shape comprising a diameter of approximately 0.475 inches, although other dimensions and configurations are possible, in accordance with the embodiments herein. In an example, the plurality of holes 25 are thru-holes extending through an entire thickness of the plate 15. In another example, the plurality of holes 25 do not extend through an entire thickness of the plate 15. The plurality of holes 25 are configured to accommodate screws, bolts, pins, or any other type of retaining device (not shown in the drawings) to connect the plate 15 to each of the first waveguide 35 and the second waveguide 40. In examples where the plurality of holes 25 are configured as thru-holes, a retaining device (e.g., screws, bolts, pins, etc.) may extend through each of the plurality of holes 25 to connect the plate 15 to each of the first waveguide 35 and the second waveguide 40. In examples where the plurality of holes 25 are not configured as thru-holes, a first set of retaining devices are used to connect the plate 15 to the first waveguide 35, and a second set of retaining devices are used to connect the plate 15 to the second waveguide 40.

Figure 2:
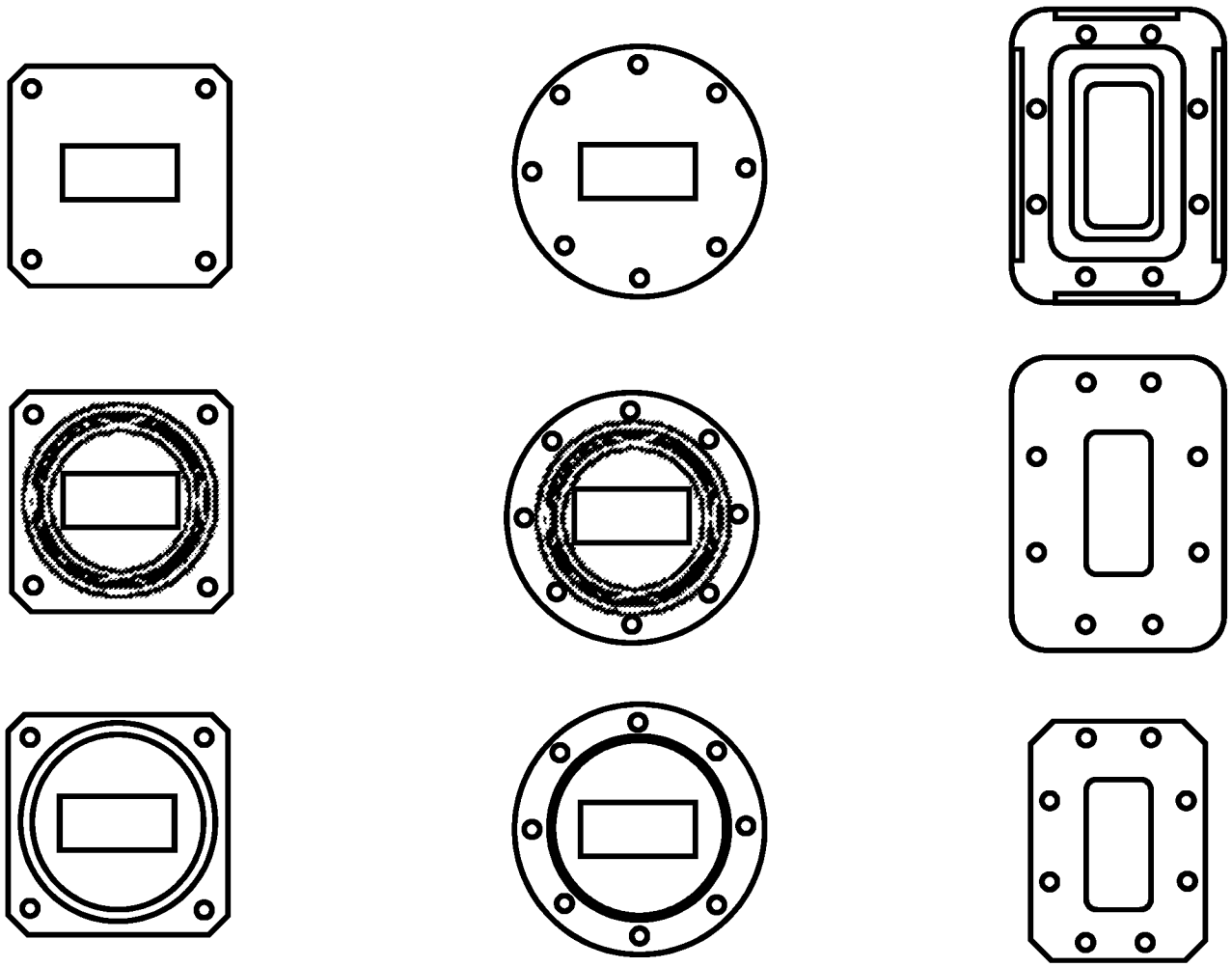
FIG. 2 (Prior Art)
FIG. 2 are schematic diagrams illustrating different types of waveguide flanges according to the prior art.

The first waveguide 35 and the second waveguide 40 may comprise any suitable type of waveguide structure used in the industry for transmission of electromagnetic signals, etc. Moreover, the first waveguide 35 and the second waveguide 40 may comprise the same type of waveguide or may be different types of waveguides compared to one another. As described above, the first waveguide 35 and the second waveguide 40 may comprise a same or different waveguide flange type to one another. FIG. 2, with reference to FIGS. 1A-1C, illustrates different types of waveguide flanges used in the industry, any of which may be used in accordance with the first waveguide 35 and the second waveguide 40. The different types of waveguide flanges appearing in FIG. 2 include a substantially square waveguide flange with four holes for attachment in the four corners of the waveguide flange, a substantially circular waveguide flange with eight holes for attachment arranged in substantially equal spacing near the outer circumference of the waveguide flange, and a substantially rectangular waveguide flange with eight holes for attachment arranged with two holes along each side of the waveguide flange. Additionally, for the square and circular waveguide flanges included in FIG. 2, there is depiction of a waveguide flange with no grooves adjacent to the aperture, grooves configured to serve as a choke, and grooves configured to accommodate a gasket. For the rectangular waveguide flange, there is depiction of a waveguide flange with no grooves adjacent to the aperture, a waveguide flange with grooves, and a miniature waveguide flange. Moreover, other types of waveguide flanges in addition to the ones shown in FIG. 2 may be used in accordance with the first waveguide 35 and the second waveguide 40.

Figure 3A:
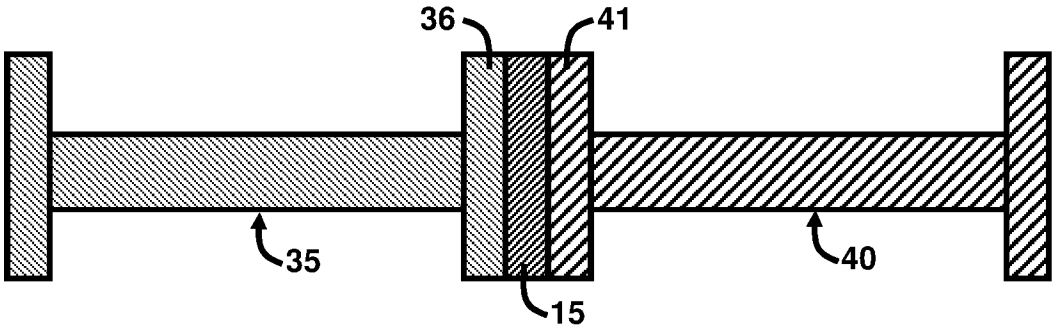
FIG. 3A is a schematic side view illustrating the waveguide flange adapter of FIG. 1A connected to flanges of a first and second waveguide, according to an embodiment herein.

FIG. 3A, with reference to FIGS. 1A-1C and 2, illustrates that the first waveguide 35 may comprise a first flange 36 and the second waveguide 40 may comprise a second flange 41. Accordingly, the first flange 36 and the second flange 41 may each comprise any of the flange types shown in FIG. 2 as well as other possible flange types. Furthermore, the first flange 36 and the second flange 41 may be the same type or may be different from one another. In an example, the first flange 36 and the second flange 41 may be configured to have the same shape as the plate 15. In another example, the first flange 36 and the second flange 41 may have a different shape than the plate 15.

Figure 3B:
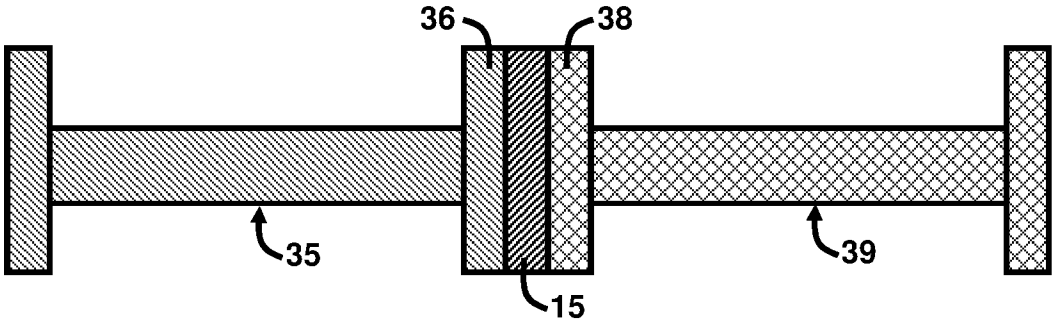
FIG. 3B is a schematic side view illustrating the waveguide flange adapter of FIG. 1A connected to flanges of a first and third waveguide, according to an embodiment herein.
Figure 3C:
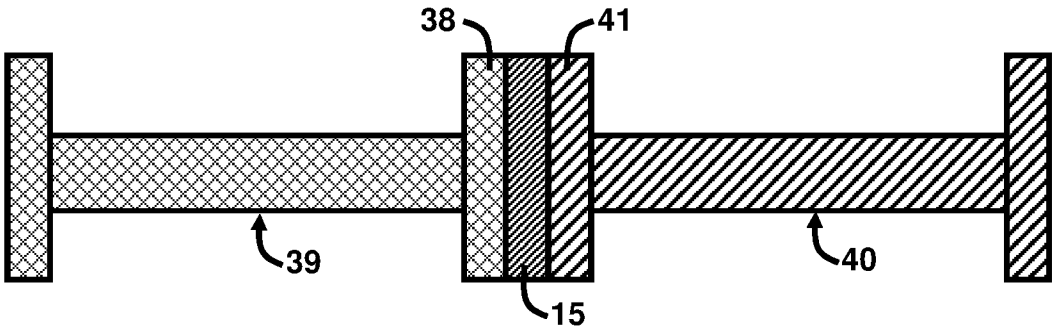
FIG. 3C is a schematic side view illustrating the waveguide flange adapter of FIG. 1A connected to flanges of a second and third waveguide, according to an embodiment herein.

FIGS. 3B and 3C, with reference to FIGS. 1A-1C, 2 and 3A, illustrates that the waveguide flange adapter 10 (FIGS. 1A and 1B) may be removed from any of the first flange 36 (FIG. 3B) and the second flange 41 (FIG. 3C) and attached to a third flange 38 (FIG. 3C) of a third waveguide 39. The third waveguide 39 may comprise any suitable type of waveguide structure used in the industry for transmission of optical and/or electromagnetic signals, etc. Moreover, the third waveguide 39 may comprise the same type of waveguide or may be different types of waveguides compared to any of the first waveguide 35 (FIG. 3B) and the second waveguide 40 (FIG. 3C). The third flange 38 may comprise any of the types of flanges shown in FIG. 2, among others, which may be used in accordance with the third waveguide 39. Moreover, other types of waveguide flanges in addition to the ones shown in FIG. 2 may be used in accordance with the third flange 38. In some examples, the third flange 38 may be configured to have the same or different shape as the plate 15.

Figure 3D:
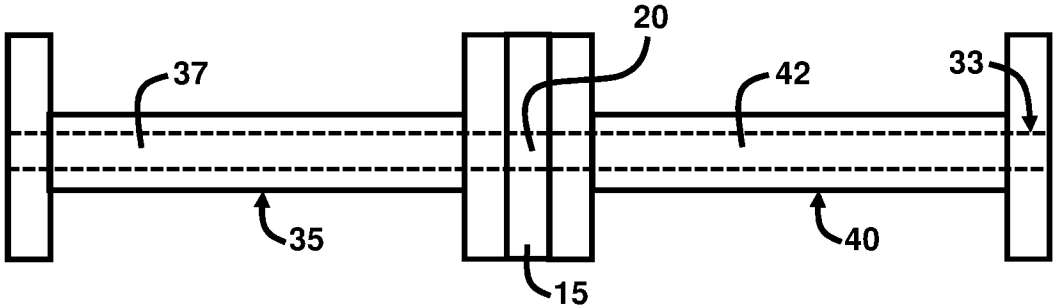
FIG. 3D is a schematic cross-sectional side view illustrating the waveguide flange adapter of FIG. 1A connected to flanges of a first and second waveguide in order to align apertures to create a continuous tube, according to an embodiment herein.

FIG. 3D, with reference to FIGS. 1A-1C, 2, 3A, 3B and 3C, illustrates that the aperture 20 of the waveguide flange adapter 10 (FIGS. 1A and 1B) may be aligned with a first hollow section 37 extending through the first waveguide 35 and a second hollow section 42 of the second waveguide 40 to permit the first hollow section 37 and the second hollow section 42 to create a continuous tube 33. In an example, the size and shape of the aperture 20 may be complementary to a size and shape of each of the first waveguide 35 and the second waveguide 40. Accordingly, the aperture 20 that aligns with the first hollow section 37 and the second hollow section 42 of the first waveguide 35 and second waveguide 40, respectively, allow for the continuous transmission of signals from (and through) the first waveguide 35 to (and through) the second waveguide 40. The first hollow section 37 and the second hollow section 42 may comprise the same or different size, shape, or configuration as one another, according to various examples. Moreover, the aperture 20 is configured to align with any size, shape, or configuration associated with each of the first hollow section 37 and second hollow section 42.

Figure 4A:
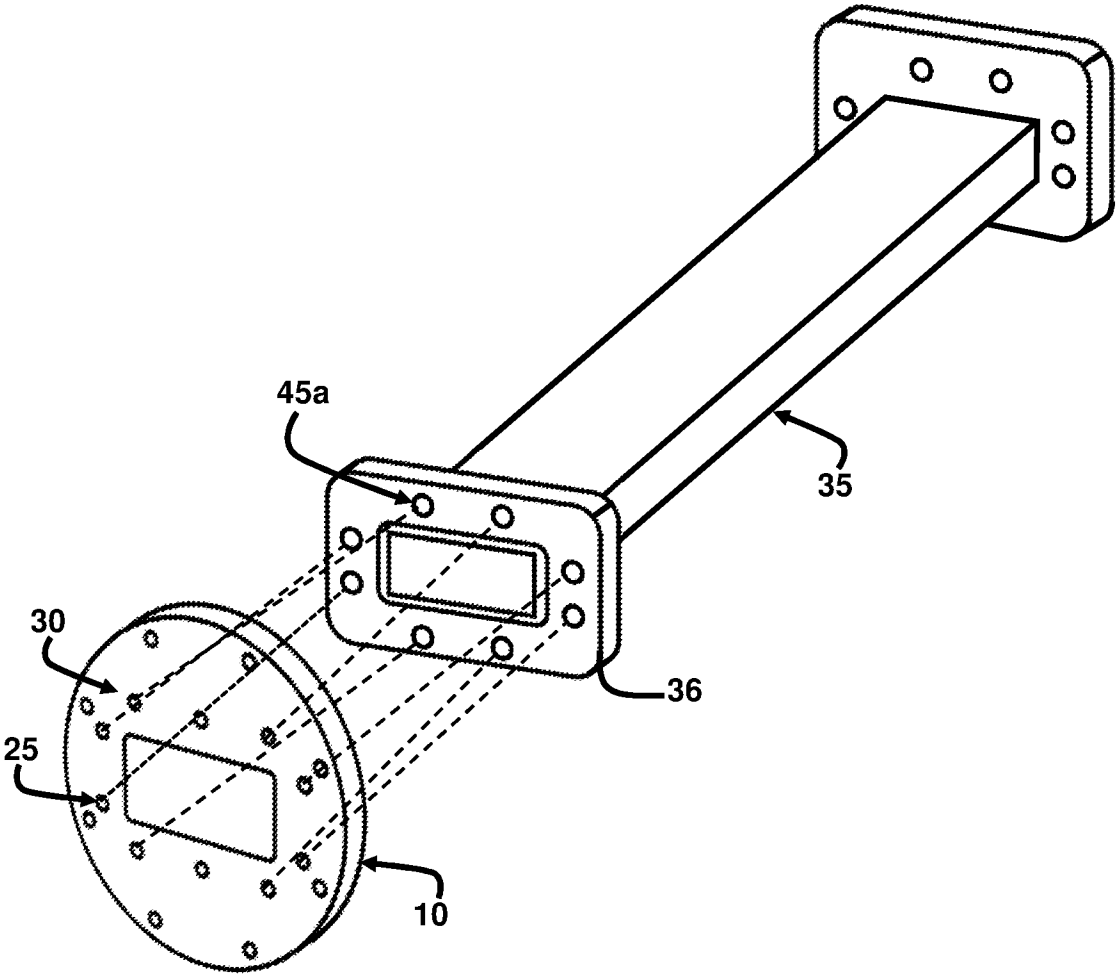
FIG. 4A is a schematic perspective view illustrating alignment of holes of a waveguide flange adapter with holes of a flange of a first waveguide, according to an embodiment herein.
Figure 4B:
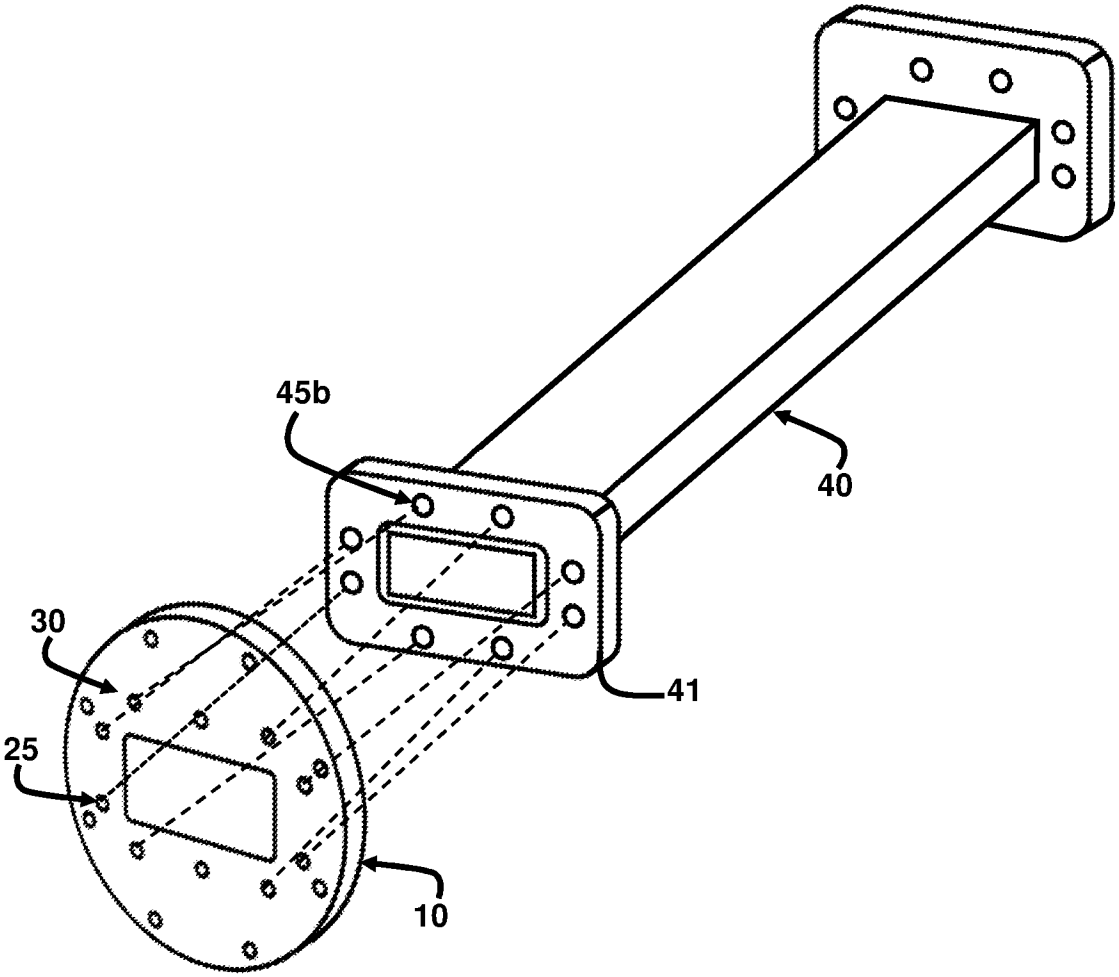
FIG. 4B is a schematic perspective view illustrating alignment of holes a waveguide flange adapter with holes of a flange of a second waveguide, according to an embodiment herein.

FIGS. 4A and 4B, with reference to FIGS. 1A-1C, 2, 3A-3D, illustrates that the pattern 30 of the plurality of holes 25 in the waveguide flange adapter 10 may be configured to align with corresponding connecting holes 45*a* (FIG. 4A), 45*b* (FIG. 4B) in each of the first waveguide 35 (FIG. 4A) and the second waveguide 40 (FIG. 4B). As described above, the plurality of holes 25 are configured to accommodate a retaining device (e.g., screws, bolts, pins, etc.). Accordingly, the alignment of the plurality of holes 25 may be chosen to be consistent with corresponding connecting holes 45*a*, 45*b* in each of the first waveguide 35 and the second waveguide 40 to permit the retaining devices (e.g., screws, bolts, pins, etc.) to extend through the plurality of holes 25 and corresponding connecting holes 45*a*, 45*b* to permit attachment of the plate 15 (FIG. 3D) to each of the first waveguide 35 and second waveguide 40. To permit disengagement of any of the first waveguide 35 and second waveguide 40 from the plate 15, the retaining devices are simply removed from first waveguide flange 36 (FIG. 4A) and second waveguide flange 41 (FIG. 4B) or from the plate 15.

Figures 5A, 5B, 5C:
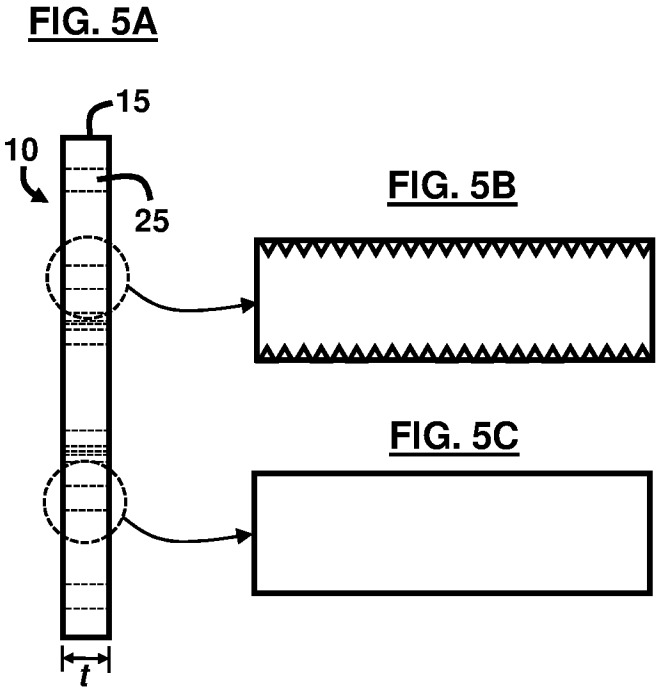
FIG. 5A is a schematic cross-sectional side view illustrating holes extending through a thickness of a plate of the waveguide flange adapter of FIG. 1A, according to an embodiment herein.
FIG. 5B is an isolated schematic cross-sectional side view illustrating tapped holes of the plate of the waveguide flange adapter of FIG. 5A, according to an embodiment herein.
FIG. 5C is an isolated schematic cross-sectional side view illustrating untapped holes of the plate of the waveguide flange adapter of FIG. 5A, according to an embodiment herein.

FIG. 5A, with reference to FIGS. 1A-1C, 2, 3A-3D, 4A, 4B, illustrates that at least some of the plurality of holes 25 (FIGS. 4A and 4B) may extend through an entire thickness t of the plate 15 of the waveguide flange adapter 10. As described above, at least some of the plurality of holes 25 may comprise thru-holes. FIG. 5B, with reference to FIGS. 1A-1C, 2, 3A-3D, 4A, 4B and 5A, illustrates that at least some of the plurality of holes 25 may be tapped, which may permit engagement with corresponding threads of a retaining device such as a screw or bolt, etc. FIG. 5C, with reference to FIGS. 1A-1C, 2, 3A-3D, 4A, 4B, 5A and 5B, illustrates that at least some of the plurality of holes 25 may be untapped, which may permit engagement with a retaining device such as a pin, etc.

Figure 6A:
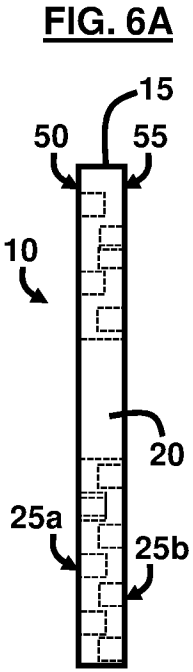
FIG. 6A is a schematic cross-sectional view illustrating holes on both sides of a plate of the waveguide adapter of FIG. 1A, according to an embodiment herein.
Figure 6B:
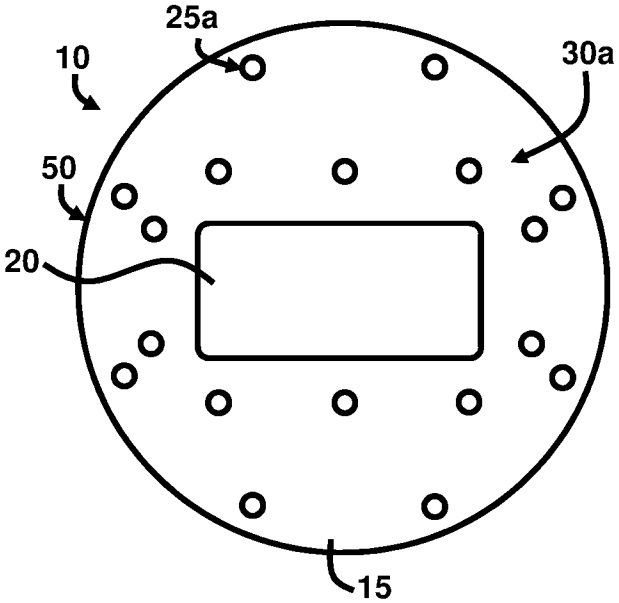
FIG. 6B is a schematic plan view illustrating holes arranged in a first pattern on a first side of the plate of the waveguide adapter of FIG. 1A, according to an embodiment herein.
Figure 6C:
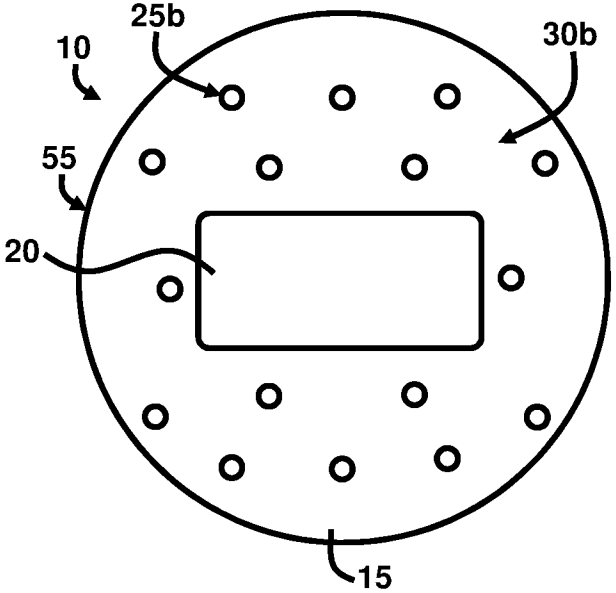
FIG. 6C is a schematic plan view illustrating holes arranged in a second pattern on a second side of the plate of the waveguide adapter of FIG. 1A, according to an embodiment herein.
Figure 6D:
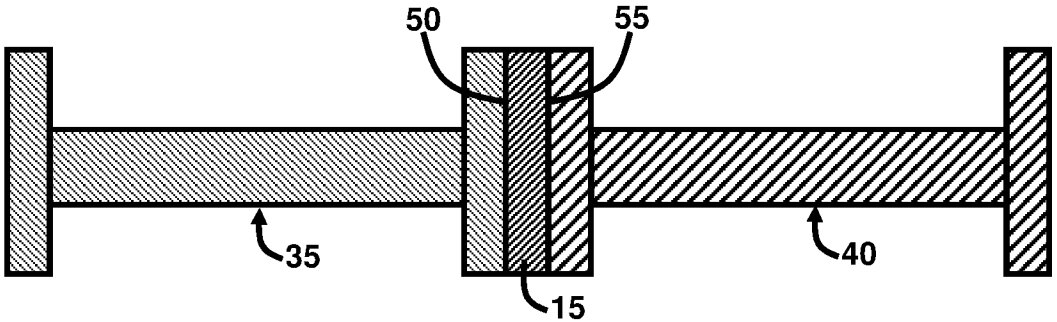
FIG. 6D is a schematic side view illustrating a first side of the plate of the waveguide adapter of FIG. 1A attached to a first waveguide, and a second side of the plate of the waveguide adapter of FIG. 1A attached to a second waveguide, according to an embodiment herein.

FIGS. 6A-6D, with reference to FIGS. 1A-1C, 2, 3A-3D, 4A, 4B, 5A-5C, illustrate that the waveguide flange adapter 10 (FIGS. 6A-6C) comprising the plate 15 (FIGS. 6A-6D) comprises a first side 50 (FIGS. 6A, 6B, and 6D) and a second side 55 (FIGS. 6A, 6C, and 6D). As shown, the plate 15 comprises an aperture 20 (FIGS. 6A-6C) positioned through a substantially central portion of the plate 15. However, other offset configurations of the positioning of the aperture 20 with respect to the plate 15 is possible, in accordance with the embodiments herein. The plate 15 further includes a first set of plurality of holes 25*a* (FIGS. 6A and 6B) arranged in a first pattern 30*a* (FIG. 6B) in the first side 50 of the plate 15 and around the aperture 20. Moreover, the plate 15 includes a second set of plurality of holes 25*b* (FIGS. 6A and 6C) arranged in a second pattern 30*b* (FIG. 6C) in the second side 55 of the plate 15. The first side 50 of the plate 15 is configured to connect to the first waveguide 35 (FIG. 6D). The second side 55 of the plate 15 is configured to connect to the second waveguide 40 (FIG. 6D). Moreover, the first waveguide 35 and the second waveguide 40 comprise a same or different waveguide flange type to one another.

According to an example, the first pattern 30*a* and the second pattern 30*b* may be the same as each other. According to another example, the first pattern 30*a* and the second pattern 30*b* may be different from one another. The first pattern 30*a* and the second pattern 30*b* containing the first set of plurality of holes 25*a* and the second set of plurality of holes 25*b* may be provided in any suitable arrangement (and not limited to the first pattern 30*a* and the second pattern 30*b* depicted in the drawings) with any suitable spacing and angle, etc. between the first set of plurality of holes 25*a* and the second set of plurality of holes 25*b*, respectively. Furthermore, the first set of plurality of holes 25*a* and second set of plurality of holes 25*b* may be configured as thru-holes or the first set of plurality of holes 25*a* and second set of plurality of holes 25*b* may not be configured as thru-holes. For example, FIG. 6A illustrates that the first set of plurality of holes 25*a* and second set of plurality of holes 25*b* are not configured as thru-holes. Accordingly, when the first set of plurality of holes 25*a* and second set of plurality of holes 25*b* are not configured as thru-holes, then the first pattern 30*a* and the second pattern 30*b* may be different from one another.

Figure 7B:
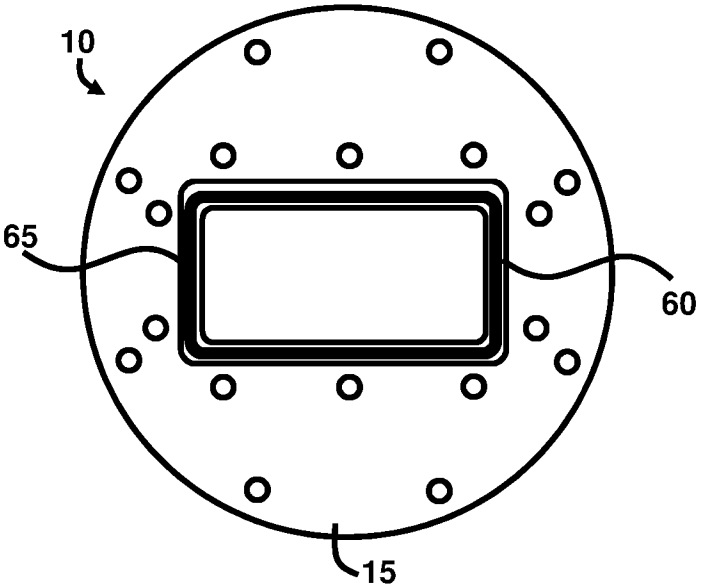
FIG. 7B is schematic plan illustrating a gasket positioned in the groove surrounding the aperture of the waveguide flange adapter of FIG. 7A, according to an embodiment herein.
Figure 7A:
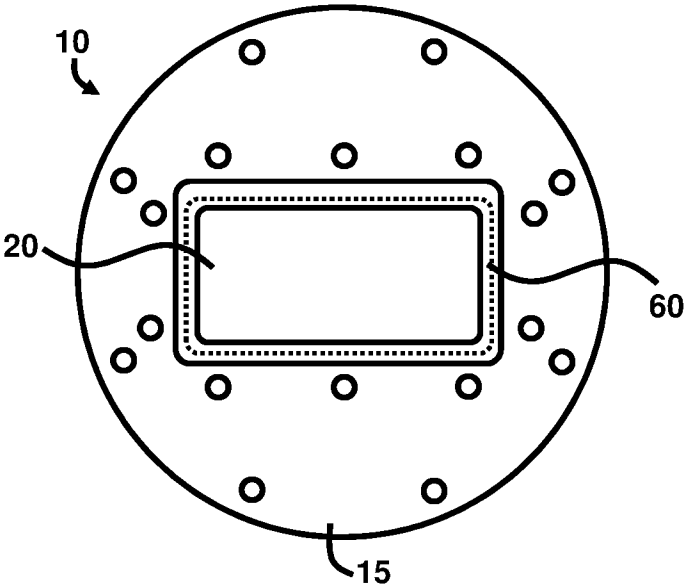
FIG. 7A is a schematic plan illustrating one or more grooves surrounding the aperture of the waveguide flange adapter of FIG. 1A, according to an embodiment herein.

FIG. 7A, with reference to FIGS. 1A-1C, 2, 3A-3D, 4A, 4B, 5A-5C, 6A-6D, illustrates that the plate 15 of the waveguide flange adapter 10 may comprise one or more grooves 60 adjacent to the aperture 20. FIG. 7B, with reference to FIGS. 1A-1C, 2, 3A-3D, 4A, 4B, 5A-5C, 6A-6D and 7A, illustrates that the plate 15 of the waveguide flange adapter 10 has more than one groove 60 that may be configured to form part or all of a choke and a groove 60 may accommodate a gasket 65. The groove 60 may be configured to be complimentary and/or consistent with a corresponding groove (not shown in the drawings) in any of the first waveguide 35 and the second waveguide 40. A choke or gasket 65 may be suitable for a pressurized waveguide application, etc. In an example, the first set of plurality of holes 25*a* and the second set of plurality of holes 25*b* do not overlap with the groove 60. This permits an uninterrupted seating of the choke or gasket 65 in the groove 60. According to an example, the groove 60 may surround the aperture 20. Furthermore, in an example, the first set of plurality of holes 25*a* and the second set of plurality of holes 25*b* do not overlap with the aperture 20. This ensures an uninterrupted transmission of signals through the connection of the first waveguide 35 with the second waveguide 40.

FIG. 8A, with reference to FIGS. 1A-1C, 2, 3A-3D, 4A, 4B, 5A-5C, 6A-6D and 7A, is a flow diagram illustrating a method 100 of connecting waveguides 35, 40, the method 100 comprising step (105) of providing a first waveguide 35 comprising a first flange 36 having a first pattern of holes; step (110) of providing a second waveguide 40 comprising a second flange 41 having a second pattern of holes; and step (115) of removably attaching a waveguide flange adapter 10 to each of the first flange 36 and the second flange 41, wherein the first pattern of holes and the second pattern of holes are either the same or different to one another. The connection, attachment, and reattachment of the waveguide flange adapter 10 with the first flange 36 of the first waveguide 35 and the second flange 41 of the second waveguide 40 may occur through the use of retaining devices (not shown), such as screws, bolts, pins, etc. The removable attachment of the waveguide flange adapter 10 to each of the first flange 36 and the second flange 41 permits the waveguide flange adapter 10 to be re-used for subsequent connection of different waveguides together. The detailed substeps for step (115) of removably attaching a waveguide flange adapter to each of the first flange and the second flange may comprise alternatives A, B, C, and D, which are further explained in FIG. 8B for alternative A, FIG. 8C for alternative B, FIG. 8D for alternative C, and FIG. 8E for alternative D. Alternatives A, B, C, and D may be used in any order and may be used together or separate in any combination thereof, depending on the current waveguide flange attachment configuration.

FIG. 8B, with reference to FIGS. 1A-1C, 2, 3A-3D, 4A, 4B, 5A-5C, 6A-6D, 7A, 7B and 8A, details alternative A for step (115) and illustrates that the method 100 may comprise step (120) of aligning a first set of plurality of holes 25*a* positioned in a first side 50 of the waveguide flange adapter 10 with corresponding connecting holes 45*a* in the first flange 36; and step (125) of aligning a second set of plurality of holes 25*b* positioned in a second side 55 of the waveguide flange adapter 10 with corresponding connecting holes 45*b* in the second flange 41. The alignment of the various holes with one another permits the proper insertion of the retaining devices (e.g., screws, bolts, pins, etc.) therein or therethrough. While alignment of the various holes is suitable for proper seating of the retaining devices, the various holes do not have to be the same size or shape as one another. For example, the first set of plurality of holes 25*a* may have the same or different size or shape as the corresponding connecting holes 45*a*. Similarly, the second set of plurality of holes 25*b* may have the same or different size or shape as the corresponding connecting holes 45*b*.

FIG. 8C, with reference to FIGS. 1A-1C, 2, 3A-3D, 4A, 4B, 5A-5C, 6A-6D, 7A, 7B, 8A and 8B, details alternative B for step (115) and illustrates that the method 100 may comprise step (130) of positioning the waveguide flange adapter 10 between the first waveguide 35 and the second waveguide 40. The positioning of the waveguide flange adapter 10 between the first waveguide 35 and the second waveguide 40 allows for transmission of signals through a continuous tube 33 created by the alignment of the aperture 20 of the waveguide flange adapter 10 and corresponding first and second hollow sections 37, 42 of the first waveguide 35 and second waveguide 40, respectively, as further described next. FIG. 8D, with reference to FIGS. 1A-1C, 2, 3A-3D, 4A, 4B, 5A-5C, 6A-6D, 7A, 7B, 8A, 8B and 8C, details alternative C for step (115) and illustrates that the method 100 may comprise step (135) of aligning an aperture 20 of the waveguide flange adapter 10 with a first hollow section 37 extending through the first waveguide 35 and a second hollow section 42 of the second waveguide 40 to permit the first hollow section 37 and the second hollow section 42 to create a continuous tube 33.

As shown in FIG. 8E, with reference to FIGS. 1A-1C, 2, 3A-3D, 4A, 4B, 5A-5C, 6A-6D, 7A, 7B, 8A, 8B, 8C and 8D, details alternative D for step (115) and illustrates that the method 100 may comprise step (140) of removing the waveguide flange adapter 10 from any of the first flange 36 and the second flange 41; and step (145) of attaching the waveguide flange adapter 10 to a third flange 38 of a third waveguide 39. The removal and/or attachment of the waveguide flange adapter 10 from any of the first flange 36, second flange 41, and third flange 38, etc. may occur by insertion and/or removal of the retaining devices (e.g., screws, bolts, pins, etc.) from the corresponding plurality of holes 25*a*, 25*b* and connecting holes 45*a*, 45*b*, as described above. Additionally, by providing a waveguide flange adapter 10 that is a separately, removable structure from each of the first waveguide 35 and second waveguide 40, the embodiments herein provide a technique to permit users to re-use certain waveguides without having to completely reconfigure, redesign, and manufacture new waveguides for subsequent use(s).

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Those skilled in the art will recognize that the embodiments herein can be practiced with modification within the spirit and scope of the appended claims.

What is claimed is:

1. A waveguide flange adapter comprising:
a plate;
an aperture positioned through the plate; and
a plurality of holes arranged in a pattern in the plate and around the aperture,
wherein the plate is configured to operatively connect a first waveguide to a second waveguide such that the first waveguide includes a first flange and the second waveguide includes a second flange, where the first and second flanges have different patterns of holes.

2. The waveguide flange adapter of claim 1, wherein the pattern of the plurality of holes is configured to align with the different pattern of holes in each of the first flange and the second flange.

3. The waveguide flange adapter of claim 1, wherein at least some of the plurality of holes extend through an entire thickness of the plate.

4. The waveguide flange adapter of claim 1, wherein the plate comprises electrically-conductive material.

5. The waveguide flange adapter of claim 1, wherein a size and shape of the aperture is complementary to a size and shape of each of the first waveguide and the second waveguide.

6. The waveguide flange adapter of claim 1, wherein at least some of the plurality of holes are tapped.

7. The waveguide flange adapter of claim 1, wherein at least some of the plurality of holes are untapped.

8. A waveguide flange adapter comprising:
a plate comprising a first side and a second side;
an aperture positioned through a substantially central portion of the plate;
a first set of plurality of holes arranged in a first pattern in the first side of the plate and around the aperture; and
a second set of plurality of holes arranged in a second pattern in the second side of the plate,
wherein the first side of the plate is configured to connect to a first waveguide,
wherein the second side of the plate is configured to connect to a second waveguide, and
wherein the first pattern and the second pattern are different.

9. The waveguide flange adapter of claim 8, comprising one or more grooves adjacent to the aperture.

10. The waveguide flange adapter of claim 9, wherein one of the one or more grooves is configured to accommodate a gasket.

11. The waveguide flange adapter of claim 9, wherein one of the one or more grooves surrounds the aperture.

12. The waveguide flange adapter of claim 9, wherein the one or more grooves comprise more than one groove that is configured to form part or all of a choke.

13. A method of connecting waveguides, the method comprising:
providing a first waveguide comprising a first flange having a first pattern of holes;
providing a second waveguide comprising a second flange having a second pattern of holes; and removably attaching a waveguide flange adapter to each of the first flange and the second flange, wherein the first pattern of holes and the second pattern of holes are different.

14. The method of claim 13, comprising:

removing the waveguide flange adapter from any of the first flange and the second flange; and attaching the waveguide flange adapter to a third flange of a third waveguide.

15. The method of claim 13, comprising aligning an aperture of the waveguide flange adapter with a first hollow section extending through the first waveguide and a second hollow section of the second waveguide to permit the first hollow section and the second hollow section to create a continuous tube.

16. The method of claim 13, comprising positioning the waveguide flange adapter between the first waveguide and the second waveguide.

17. The method of claim 13, comprising:

aligning a first set of plurality of holes positioned in a first side of the waveguide flange adapter with corresponding connecting holes in the first flange; and aligning a second set of plurality of holes positioned in a second side of the waveguide flange adapter with corresponding connecting holes in the second flange.

* * * * *